United States Patent [19]

Current et al.

[11] 4,117,791

[45] Oct. 3, 1978

[54] DUAL COLOR CODED SEWING MACHINE NEEDLES

[75] Inventors: Wayne A. Current, Holmdel; Bruce I. Genge, South Plainfield; Herbert J. Hurme, Morristown, all of N.J.; Josef Zocher, Haaren, Aachen, Fed. Rep. of Germany

[73] Assignee: The Singer Company, New York, N.Y.

[21] Appl. No.: 860,343

[22] Filed: Dec. 14, 1977

[51] Int. Cl.[2] ..... D05B 85/00

[52] U.S. Cl. ..... 112/222

[58] Field of Search ..... 112/222, 223; 223/102; 128/335

[56] References Cited

FOREIGN PATENT DOCUMENTS 1,710,769 11/1955 Fed. Rep. of Germany ..... 112/222

19,125 7/1962 Japan ..... 112/222

OTHER PUBLICATIONS

Reference Data for Radio Engineers, Fifth Edition, pp. 5–9.

*Primary Examiner*—Henry Jaudon

*Attorney, Agent, or Firm*—William V. Ebs; Edward L. Bell; Robert E. Smith

[57] ABSTRACT

A dual color coding system is disclosed for sewing machine needles in which the color appearing on one area of the needle denotes the needle type, whereas that appearing on another area denotes the needle size. A dye which leaves no discernable surface coating is applied to the needle shank to denote one of the characteristics, preferably needle type; whereas a narrow band of pigmented material is applied as a surface coating over the dye colored surface at the juncture of the needle shank and blade to denote another characteristic, preferably needle size.

4 Claims, 6 Drawing Figures

Fig. 1
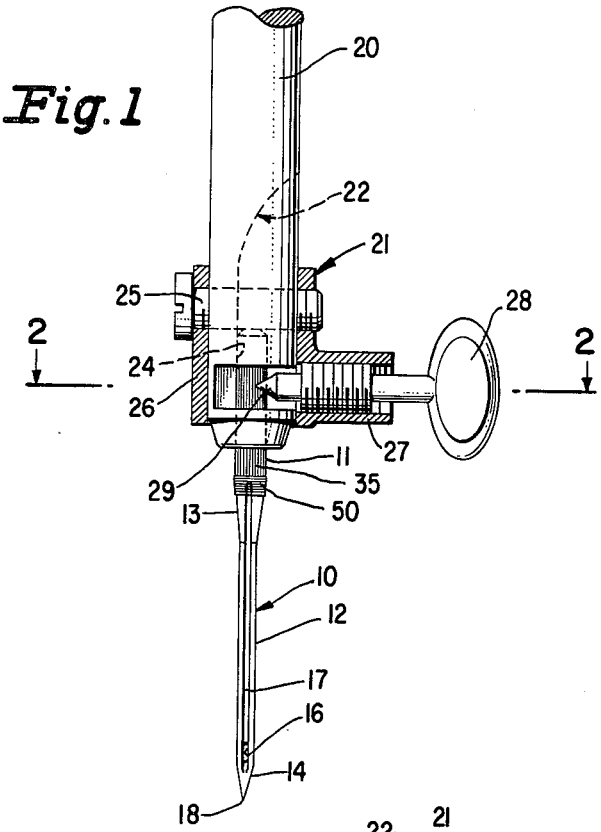
Fig. 2
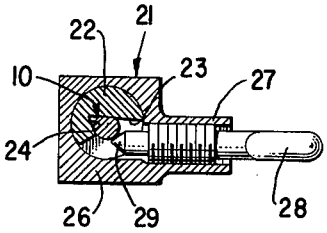
Fig. 4
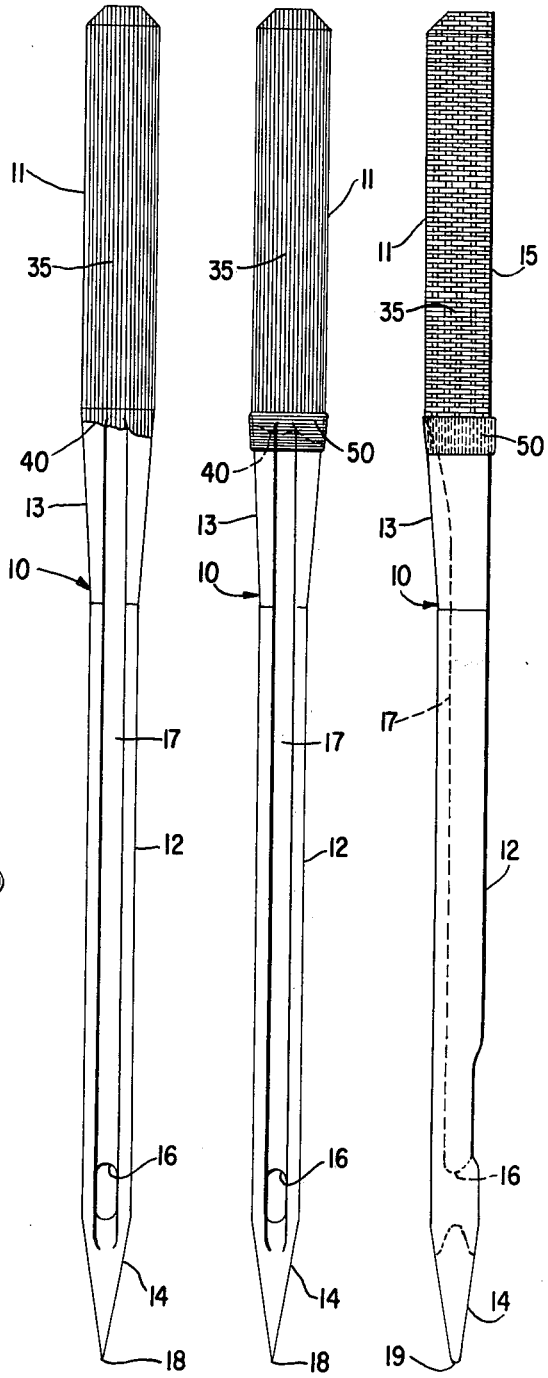
Fig. 3
Fig. 5
Fig. 6
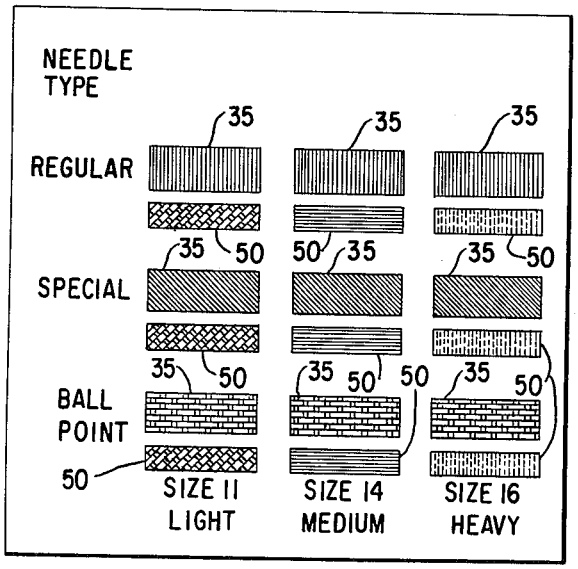

DUAL COLOR CODED SEWING MACHINE NEEDLES

BACKGROUND OF THE INVENTION

Sewing machine needles have heretofore been marked with a selected one of a group of different colors to indicate a single characteristic such as blade size or needle type. Recent needle developments have resulted in the existence of a variety of new needle types, such as ball point needles, particularly suited for use on synthetic fiber textiles or on knit fabrics. Since these new needle types as well as regular needles are supplied in a variety of blade sizes, use of a single color for coding becomes confusing because of the increasing difficulty of maintaining identity as between the increasingly similar colors.

SUMMARY OF THE INVENTION

This invention relates to a dual color coding system for sewing machine needles, and more particularly, to a dual color coding system which imposes a minimum of adverse influence on the functioning of the needle during operation of the sewing machine, and which provides for a high quality appearance of the finished needle.

These objects of the invention are attained by providing a first color coded area by the needle shank by applying a dye which leaves no discernable surface coating, and therefore, does not interfere with the positioning of the needle in a sewing machine needle clamp. A second color coded area is provided by application of a narrow band of pigmented material which deposits a surface coating at the juncture of the needle shank and blade. This location on the needle is beneath the area which cooperates with the sewing machine needle clamp so that the surface coating will not interfere with needle position in the clamp; the location is above the full depth portion of the long thread accommodating groove in the needle blade, and therefore, minimizes interference with passage of sewing threads along the groove. Furthermore, the location overlies the border of the first color coded area and covers any unevenness or irregularity in the application of the dye so that a quality appearance is provided.

DESCRIPTION OF THE DRAWINGS

A preferred embodiment of this invention is illustrated in the accompanying drawings in which:

FIG. 1 is a vertical cross sectional view of a sewing machine needle clamp with a sewing machine needle color coded in accordance with this invention clamped therein;

FIG. 2 is a transverse cross sectional view through the needle clamp taken substantially along line 2—2 of FIG. 1;

FIG. 3 is an enlarged elevational view of a sewing machine needle viewed from the long groove side and having only the first of the two color codings in accordance with this invention applied thereto;

FIG. 4 is an enlarged elevational view of the sewing machine needle of FIG. 2 showing both color codings applied thereto in accordance with this invention;

FIG. 5 is an enlarged elevational view of a different type of sewing machine needle than that shown in FIGS. 2 and 3 view perpendicular to the long groove and color coded in accordance with this invention, and FIG. 6 is a chart indicating a preferred dual color coding system for three different types of sewing machine needles each supplied in three different sizes.

Referring to FIGS. 3, 4 and 5, household sewing machine needles are disclosed and indicated generally at 10. Each of the needles 10 is formed with a shank 11 and a blade portion 12 which joins the shank 11 at a tapered shoulder 13 and which is formed at the free extremity with a point 14. The shank 11 of household sewing machine needles is usually formed at one side with a flat 15 which serves to orient the needle in the needle clamp of the sewing machine. The needle blade 12 near the point 14 is formed with a transverse thread eye 16 which is joined along one side of the blade with a long groove 17 which extends full depth up to the shoulder 13 where the groove gradually decreases in depth, terminating beneath the shank 11. The purpose of the long groove is to accommodate and shelter the supply limb of thread carried through the needle eye so as to minimize frictional drag on this limb of thread during work penetration by the needle.

It will be appreciated that the needle size is determined by the diameter of the needle blade 12, the three most common sizes being size 11, approximately 0.030 inches in diameter for light fabrics; size 14 approximately 0.036 inches diameter for medium fabrics; and size 16, approximately 0.040 inches diameter for heavy fabrics.

Various types of needles are also in demand, of which two are illustrated in the accompanying drawings. FIGS. 3 and 4 illustrate a needle with a sharp pointed extremity 18 which may be termed a regular needle. FIG. 5 illustrates a needle with a blunt rounded extremity 19 referred to as a ball point needle. Other needle types, such as scarfed needles, or the like which might be referred to as special needles may be accommodated in the dual color coding system of this invention.

As shown in FIGS. 1 and 2, a sewing machine needle bar 20 carries at its lower extremity a needle clamp indicated generally at 21 which serves to secure any selected one of the needles 10 to the needle bar 20. The lower extremity of the needle bar 20 is formed with an axial slot 22 defining a flat rear wall 23 against which the flat 15 of a needle 10 is adapted to be positioned, and a sidewall 24 projecting angularly from the rear wall and against which the needle shank may be located.

Secured to the needle bar by a fastening 25 arranged transversely of the needle bar is a needle clamp body 26 formed with an internally threaded lateral boss 27 which accommodates a needle clamping screw 28. The screw 28 extends into slot 22 in the needle bar and is formed with a conically shaped free extremity 29 adapted to engage and force the needle shank 11 against the slot walls 23 and 24. The fastening 25 in addition to securing the needle clamp on the needle bar also serves as a stop abutment against which the needle shank may be placed to establish a predetermined positioning of a needle in the needle clamp.

For establishing a visible code indicative of one characteristic of the sewing machine needles, for instance, the type of needle, the entire needle shank 11 is treated with a vehicle preferably a synthetic air drying lacquer such as poly-vinyl chloride lacquer in which a dye agent is disolved. Any known dye such as a lake color precipitated dye which may be disolved in the lacquer vehicle may be used. The particle size of the dissolved dye agent in the vehicle is extremely small and as a result the coating deposited on the needle shank may be of no discernable thickness. Consequently, when the needle so treated is placed in a needle clamp, as shown in FIGS. 1 and 2, the presence of the dyed area on the shank 11 of the needle will not adversely influence the orientation of the needle in the needle clamp nor will it adversely affect the rigidity of the grip which the needle clamp exerts on the needle.

As shown in FIG. 3, the edge 40 of the dyed area on the needle shank 11 may be left irregular without influencing the final appearance of the finished needle for the reason that a second colored area 50 indicative of a second characteristic of sewing machine needles, as for instance, size, is provided by placing a narrow band of material which deposits an opaque surface coating over and covering the edge 40 of the dyed area and extending on the shoulder 13 of the needle.

Preferably the second colored area may be provided by the application of a vehicle, preferably poly-vinyl chloride lacquer in which a pigment such as a powdered chrome or nitrate color is mixed as a suspension. Preferably a particle size of the pigment above 40 microns is maintained so that a discernable opaque surface coating will result from its application to the needle.

The opaque characteristic of the second colored area 50 not only covers and obscures a possibly unsightly edge 40 of the dyed colored area 35, but it provides for an integrity of color for the second colored area 50 regardless of the color of the underlying dyed area 35.

The second colored area 50 is located above the needle blade 12 and preferably, is located on the upper portion of the shoulder 13 of the needle below the shank 11 and above the full depth portion of the long groove 17 of the needle. As a result, the second colored area 50 will be located completely beneath and out of contact with the needle clamp 21 so that the surface coating will not adversely affect orientation or rigidity of support for the needle on the needle clamp. Being on the tapered shoulder 13, the added thickness of the coating of the second colored area will be largely contained within the axial projection of the needle shank so as not to interfere even with old fashioned needle clamps which accommodate the entire needle shank. The second colored area 50, furthermore, will remain readily visible when the needle is in use on a sewing machine as will a segment of the first colored area 35 as shown in FIG. 1.

Being above the full depth portion of the long groove 17, the surface coating of the second colored area 50 will not adversely affect the passage of thread along the long groove during sewing.

Illustrated in FIG. 6, is a chart setting forth a preferable dual color coding system which may be used in accordance with this invention. The dual color coding for each of nine different needles is provided, one each of three different sizes 11, 14 and 16 in three types; regular, special and ball point. The upper segment of each color code in the chart in FIG. 6 corresponds to the first color coded area 35 on the needles and designates the needle type; red denoting the regular needles; green, the special needles; and yellow, the ball point needles. The lower segment of each color code in the chart in FIG. 6 corresponds to the second color coded area 50 on the needles and designates the needle size; orange denoting size 11 for light work; blue, size 14 for medium work; and purple, size 16 for heavy work.

The dual color coding system of this invention thus provides for the identification of a large variety of different needles with a minimum of different colors; it accomplishes such identification without adversely affecting the functioning of the needles; and it enhances the quality appearance of the needles.

Having thus set forth the nature of the invention, what is claimed herein is:

1. A sewing machine needle having a shank portion adapted to cooperate with the needle clamp on a sewing machine needle bar, a blade portion formed with a needle eye and a thread accommodating groove extending from said eye at substantially uniform depth along said blade, and a shoulder portion at the juncture of said shank and blade portion, a dual color coding system comprising a a first color coded area of uniform color having predetermined correlation to a first characteristic of said needle and provided by a dye which leaves no discernable surface coating, said first color coded area extending on said needle shank, and a second color coded area of uniform color having predetermined correlation to a second characteristic of said needle and provided by a layer of opaque material applied as a surface coating on said needle shoulder.

2. A sewing machine needle as set forth in claim 1 in which said first color coded area extends onto said needle shoulder and underlies the surface coating defining said second color coded area.

3. A sewing machine needle as set forth in claim 1 in which said first color coded area comprises a treatment of said needle shank with a dye dissolved in a lacquer vehicle and in which the second color coded area comprises a layer of pigment material having a particle size of at least 40 microns suspended in a lacquer vehicle.

4. A dual color coding system for sewing machine needles which include a shank portion, a blade portion and a shoulder at the juncture of said shank and blade portions, said dual color coding system facilitating identification of regular, ball point, and special type needles in light, medium, and heavy blade sizes and comprising a colored area on said needle shank provided by application of a dye which leaves no discernable surface coating and colored red to denote regular needles, yellow to denote ball point needles, and green to denote special needles, and a narrow band of colored material applied as a surface coating between the needle blade and said colored area on said needle shank and colored orange to denote light blade size, blue to denote medium blade size and purple to denote heavy blade size.

* * * * *